US008177491B2

(12) United States Patent
Noelle et al.

(10) Patent No.: US 8,177,491 B2
(45) Date of Patent: May 15, 2012

(54) VARIABLE GEOMETRY NOZZLE DEVICE

(75) Inventors: Phillipe Noelle, Vincey (FR); Mike Brown, Skelmersdale (GB)

(73) Assignee: Honeywell International Inc., Morristown, NJ (US)

( * ) Notice: Subject to any disclaimer, the term of this patent is extended or adjusted under 35 U.S.C. 154(b) by 921 days.

(21) Appl. No.: 11/997,338

(22) PCT Filed: Aug. 2, 2005

(86) PCT No.: PCT/US2005/027570

§ 371 (c)(1),
(2), (4) Date: Sep. 2, 2008

(87) PCT Pub. No.: WO2007/018528

PCT Pub. Date: Feb. 15, 2007

(65) Prior Publication Data

US 2009/0016875 A1 Jan. 15, 2009

(51) Int. Cl.
*F01B 25/02* (2006.01)

(52) U.S. Cl. ..... 415/164; 415/209.3

(58) Field of Classification Search ..... 415/148, 415/150, 159–166

See application file for complete search history.

(56) References Cited

U.S. PATENT DOCUMENTS

| | | | | | |
|---|---|---|---|---|---|
| 2,976,013 | A | * | 3/1961 | Hunter | 415/110 |
| 4,338,063 | A | | 7/1982 | Nakanishi | |
| RE31,835 | E | * | 2/1985 | Rannenberg | 417/282 |
| 4,573,874 | A | * | 3/1986 | Andersen et al. | 416/157 R |
| 5,207,559 | A | | 5/1993 | Clevenger et al. | |
| 5,895,204 | A | * | 4/1999 | Sishtla et al. | 415/148 |
| 5,899,661 | A | * | 5/1999 | Sishtla et al. | 415/150 |
| 5,988,977 | A | * | 11/1999 | Gallagher et al. | 415/208.3 |
| 6,015,259 | A | * | 1/2000 | Sishtla et al. | 415/166 |
| 6,099,168 | A | * | 8/2000 | Sishtla | 384/549 |
| 6,506,011 | B1 | * | 1/2003 | Sishtla | 415/1 |
| 6,554,567 | B2 | * | 4/2003 | Sishtla | 415/150 |
| 6,672,293 | B1 | * | 1/2004 | Yokoyama et al. | 123/568.21 |
| 2005/0123397 | A1 | | 6/2005 | McArdle et al. | |

FOREIGN PATENT DOCUMENTS

| | | | |
|---|---|---|---|
| DE | 3844189 | * | 7/1990 |
| DE | 10238412 | * | 3/2004 |
| EP | 0685652 | | 5/1995 |
| EP | 1413763 | * | 4/2004 |

OTHER PUBLICATIONS

PCT/ISR Honeywell.

* cited by examiner

*Primary Examiner* — Steven Loke
*Assistant Examiner* — Victoria Hall
(74) *Attorney, Agent, or Firm* — Alston & Bird LLP

(57) ABSTRACT

A compressor nozzle device comprises a set of adjustable vanes which is interposed between two opposite wall members (3, 5), and a unison ring (7) for actuating said vanes (1). The unison ring (7) is arranged at a side of one of said wall members (3) opposite to the other side thereof facing the vanes (1).

6 Claims, 15 Drawing Sheets

PRIOR ART

PRIOR ART

PRIOR ART

PRIOR ART

VARIABLE GEOMETRY NOZZLE DEVICE

The invention relates to a nozzle device and especially to a compressor nozzle device for a variable geometry compressor.

Variable geometry nozzle systems with adjustable pivot vane configurations require the vanes to be assembled as integral parts of a center housing. In order to simplify a manufacturing process, recently a variable geometry nozzle device design has been introduced by the applicants.

Such a device can be constructed as a sub assembly separate from, e.g., the remainder of a turbocharger. Thus, the assembled nozzle device forms a vane cartridge. This vane cartridge can be simply inserted into a gap between a compressor housing and a center housing during manufacturing. This makes manufacturing considerably easier as the components need not be assembled in the same place. Moreover, with this vane cartridge system the compressor housing and the cartridge can be preassembled and aerodynamically tested before they are attached to the center housing.

FIGS. 1 to 4 show a nozzle device for a variable geometry compressor and a housing for a compressor into which the nozzle device is incorporated. The housing 101 has an inlet, a shroud groove, a volute, a diffuser plate 103 and a backplate 109. In the backplate 109, a groove for receiving a unison ring 105 is provided. The unison ring 105 serves to adjust a set of adjustable vanes 107 positioned between the diffuser plate 103 and the unison ring 105 arranged on the side of the backplate 109. Spacers 106 are provided for ensuring a predetermined distance between the backplate 109 and the diffuser plate 103. The backplate 109, the unison ring 105, the vanes 107, the diffuser plate 103 and the spacers 106 form the nozzle device.

The nozzle device is inserted into the housing 101 and, together with the housing 101, is fixed to a center housing and rotating assembly (CHRA) 150 by bolts 108 at the side opposite the inlet. Thus, the components are secured. An O-ring 110 is provided between a CHRA 150 and the housing 101 to provide a seal.

There exists a need for a nozzle device having an improved performance and having an improved functionality.

According to a first aspect of the invention, a compressor nozzle device comprises a set of adjustable vanes which are interposed between two opposite wall members attached to each other. Furthermore, a unison ring for actuating said vanes is arranged at a side of one of said wall members, which is opposite to the side facing the vanes.

Advantageously, guiding slots can be provided in the one wall member. These guiding slots serve to guide actuating portions of the vanes. The actuating portions are engaged by the unison ring.

Furthermore, the one wall member can have assembly slots through which the respective actuating portions of the vanes are passed when the device according to the invention is assembled.

Preferably, the actuating portions of the vanes are positioned in corresponding actuating slots provided in the unison ring. In order to rotate the vanes, the actuating slots of the unison ring come into engagement with the corresponding actuating portions of the vanes.

Thereby, the respective vanes are rotated around a pivot portion which is received in a pivot hole. The pivot hole can be provided in any of the wall members. Advantageously, the pivot hole is provided in the one wall member which has the unison ring arranged on the side opposite the side facing the vanes.

Furthermore, advantageously the guiding slots and the assembly slots are either covered by the unison ring or by the respective vanes or by both. Thus, an airflow is prevented from passing through the guiding slots or through the assembly slots.

Due to this arrangement, no moving parts except the vanes themselves are exposed to an air flow. This minimizes the risk of dust contained in the airflow accumulating and being deposited near the moving parts such as the unison ring, causing sticking of these moving parts. Furthermore, the aerodynamic efficiency of the nozzle device is improved.

According to a second aspect of the invention, a nozzle device is provided, which comprises two opposite wall members. Interposed between these two opposite wall members is a set of adjustable vanes. A unison ring for actuating the vanes is provided in a groove provided in one of the wall members. The groove has a circumferential slot in which the unison ring is axially locked.

Advantageously, in the groove circumferential recesses are provided, which serve to receive corresponding protrusions provided on the periphery of the unison ring. After axially inserting the unison ring into the groove, the unison ring can be twisted such that the protrusions of the unison ring are housed in the circumferential slot. The groove, the circumferential recesses and the slot form a kind of bayonet socket. Thus, the protrusions of the unison ring are held in the circumferential slot, and thereby an axial movement of the unison ring is prevented.

According to a third aspect of the invention, a compressor nozzle device has a cartridge comprising a set of adjustable vanes which is interposed between two opposite wall members attached to each other. The cartridge is attached to a compressor volute such that one of said wall members is fixedly mounted to the volute. The other wall member, however, is movably fitted to the compressor volute.

Advantageously, the movable fit of the other wall member is accomplished by means of a liquid sealant.

The invention will now be explained in detail, using preferred embodiments as examples, with reference being made to the drawings in which.

Figure 12:
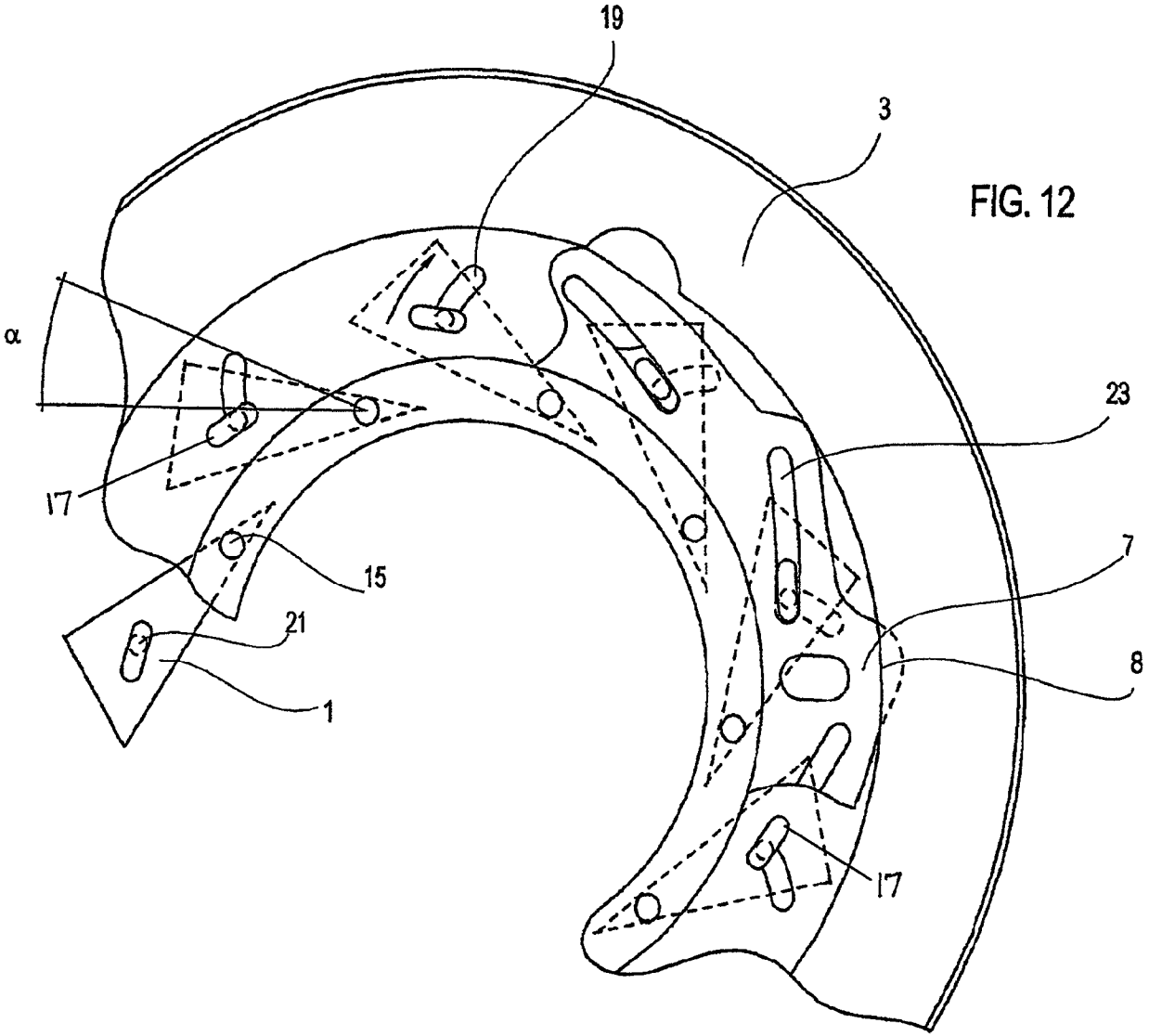
FIG. 12 shows a top view of a portion of the compressor nozzle device.
Figure 12A:
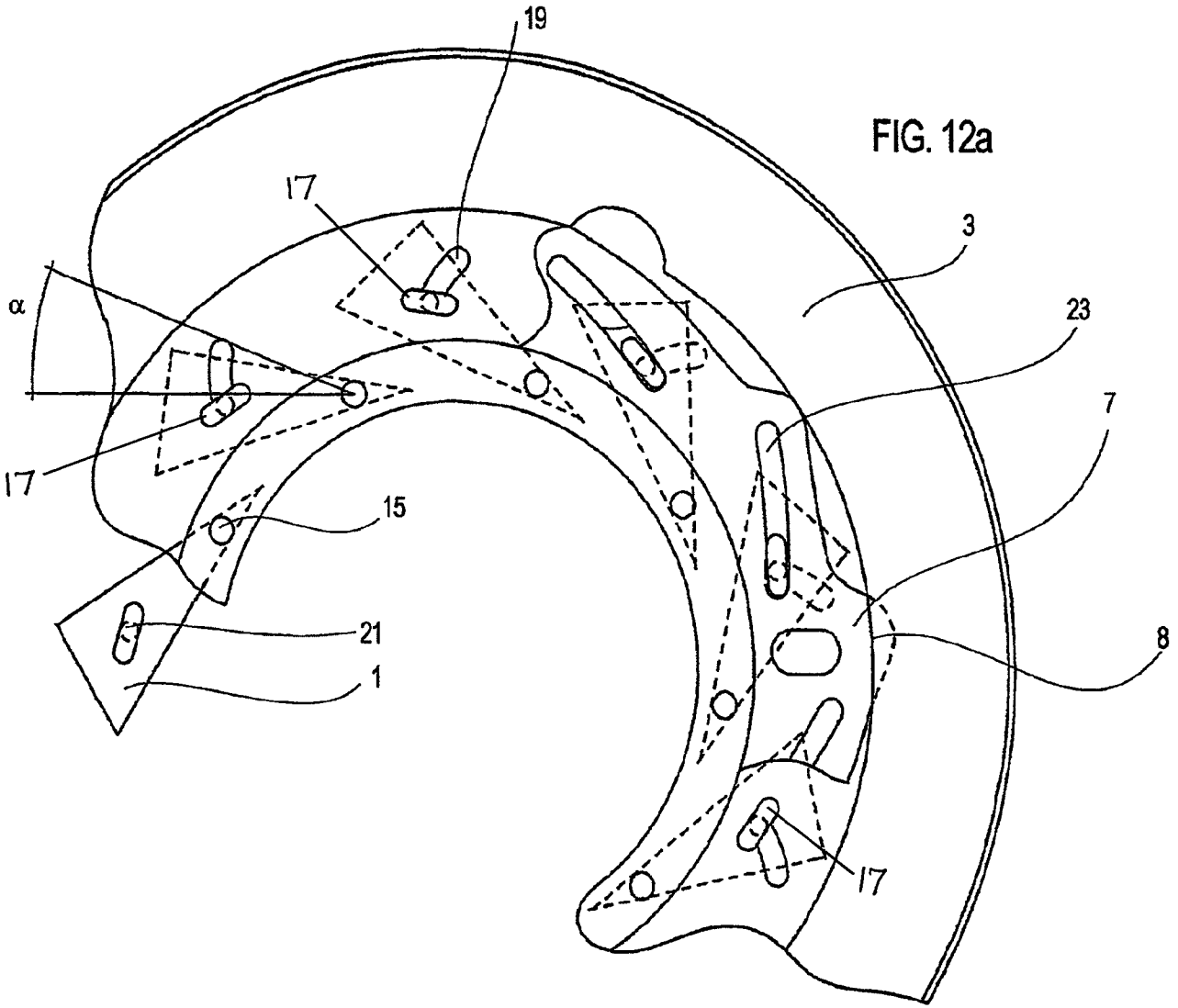
Figure 12B:
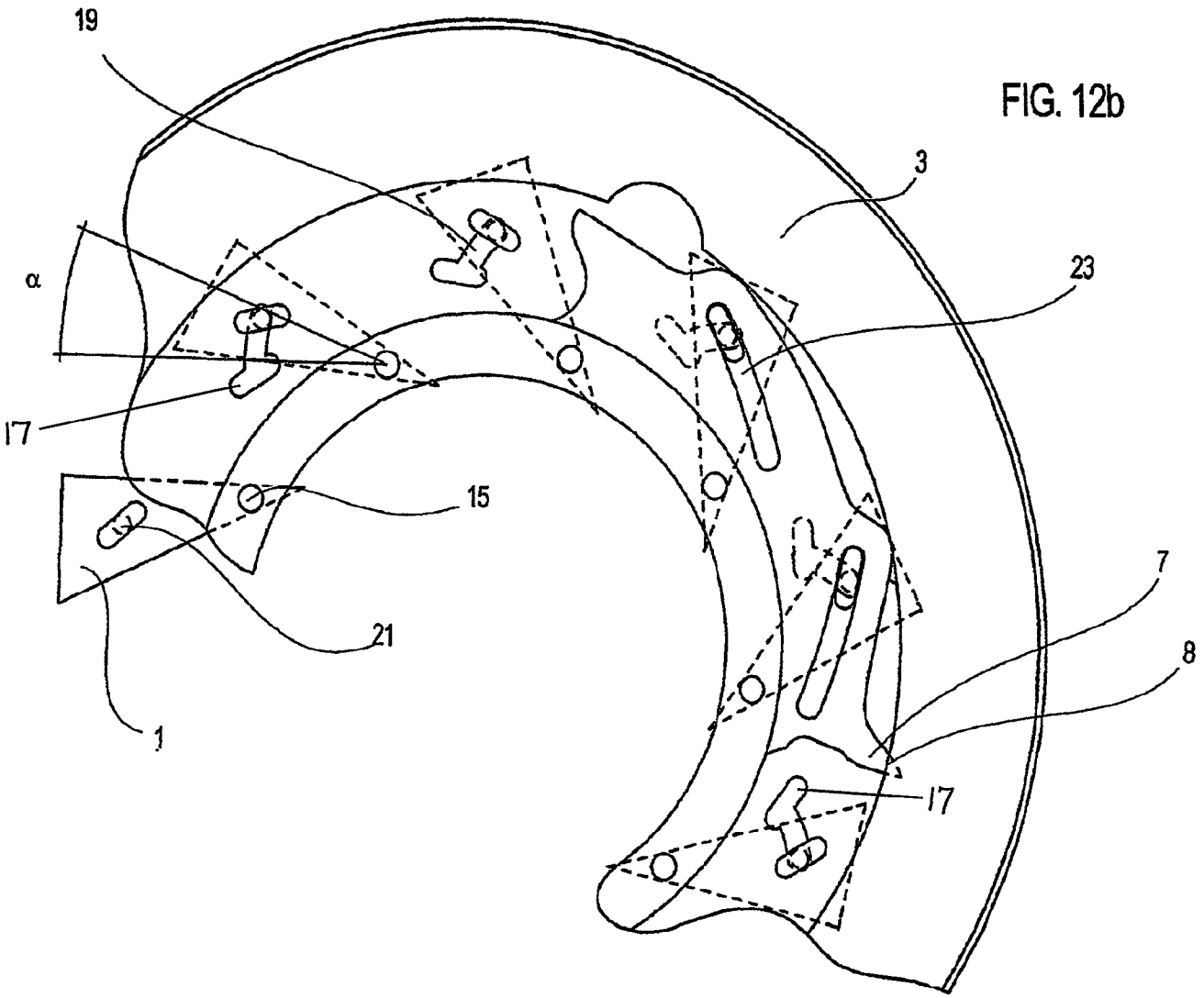

FIGS. 12*a* and 12*b* show a top view of a section of the compressor nozzle device for explaining a vane actuating mechanism.

Figure 13:
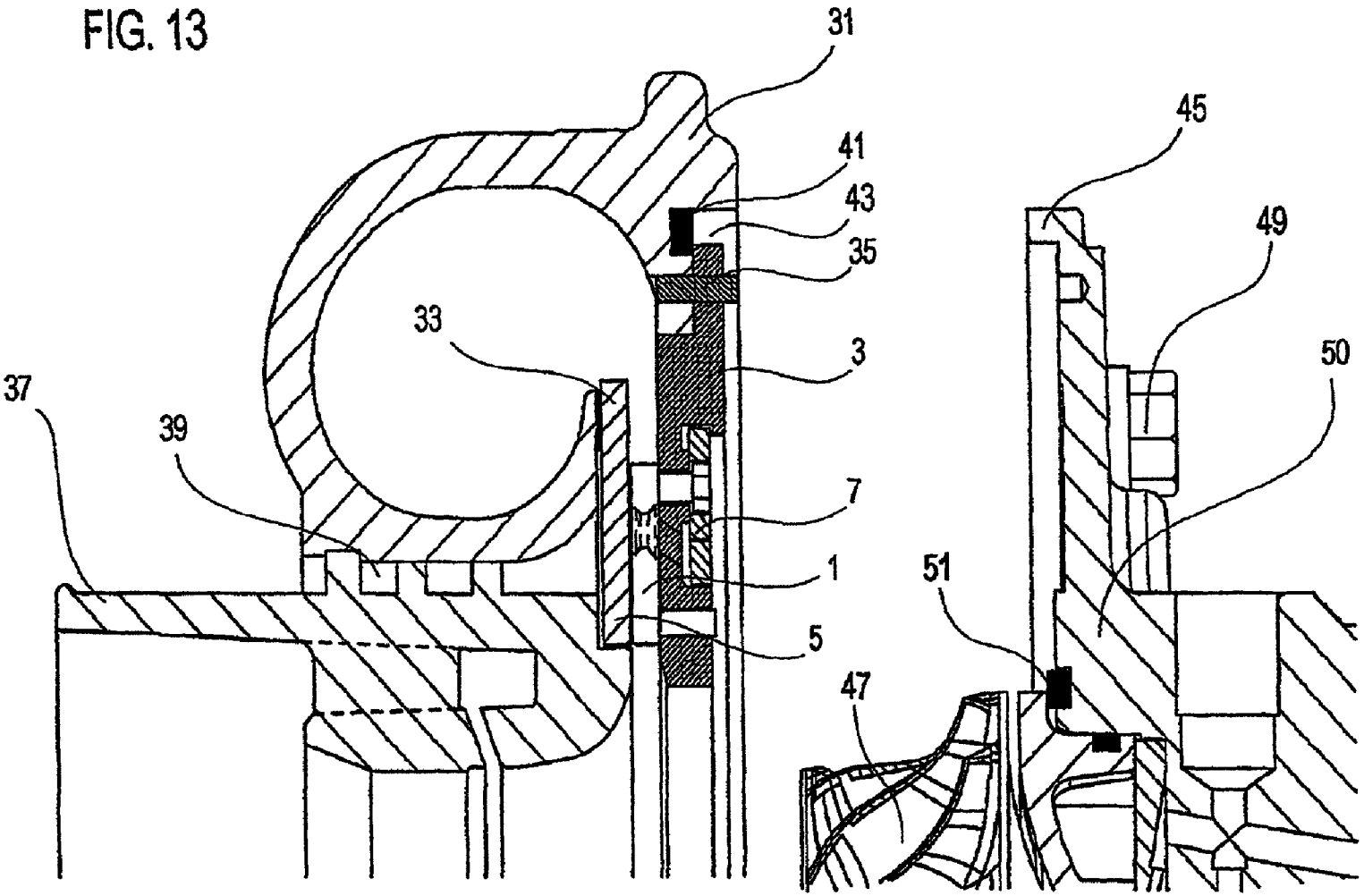

FIG. 13 shows a sectional view of a compressor nozzle device attached to a volute and a center housing and a rotating assembly of a turbocharger, to which the compressor nozzle device is to be attached.

Figure 14:
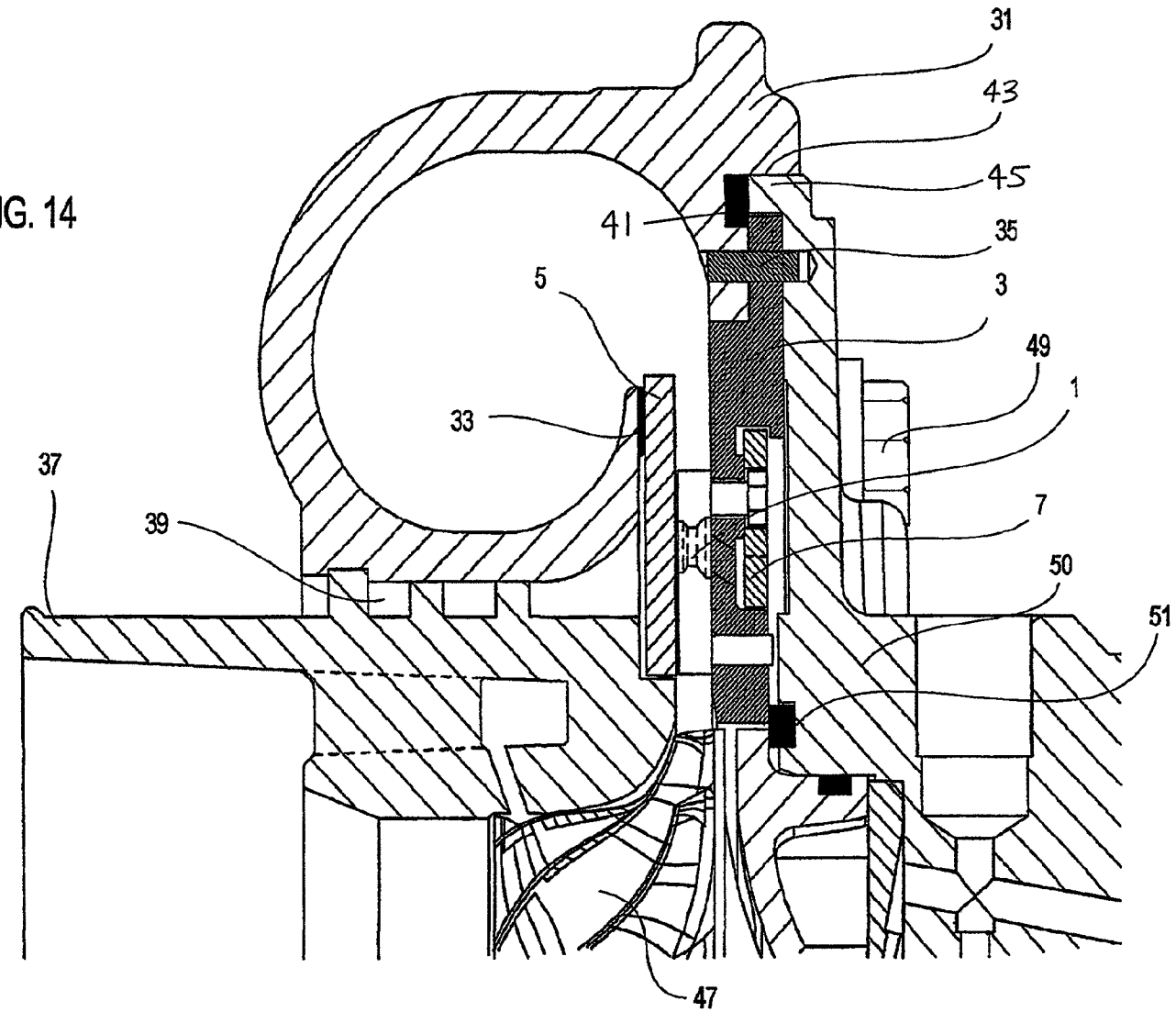

FIG. 14 shows a sectional view of the compressor nozzle device attached to the volute and the center housing and rotating assembly of a turbocharger after the attachment.

A compressor nozzle device as is used in a turbocharger of an internal combustion engine is described with reference to FIGS. 5 to 14.

The components and the assembly of such a compressor nozzle device are described with reference to FIGS. 5 to 8.

Figure 1:
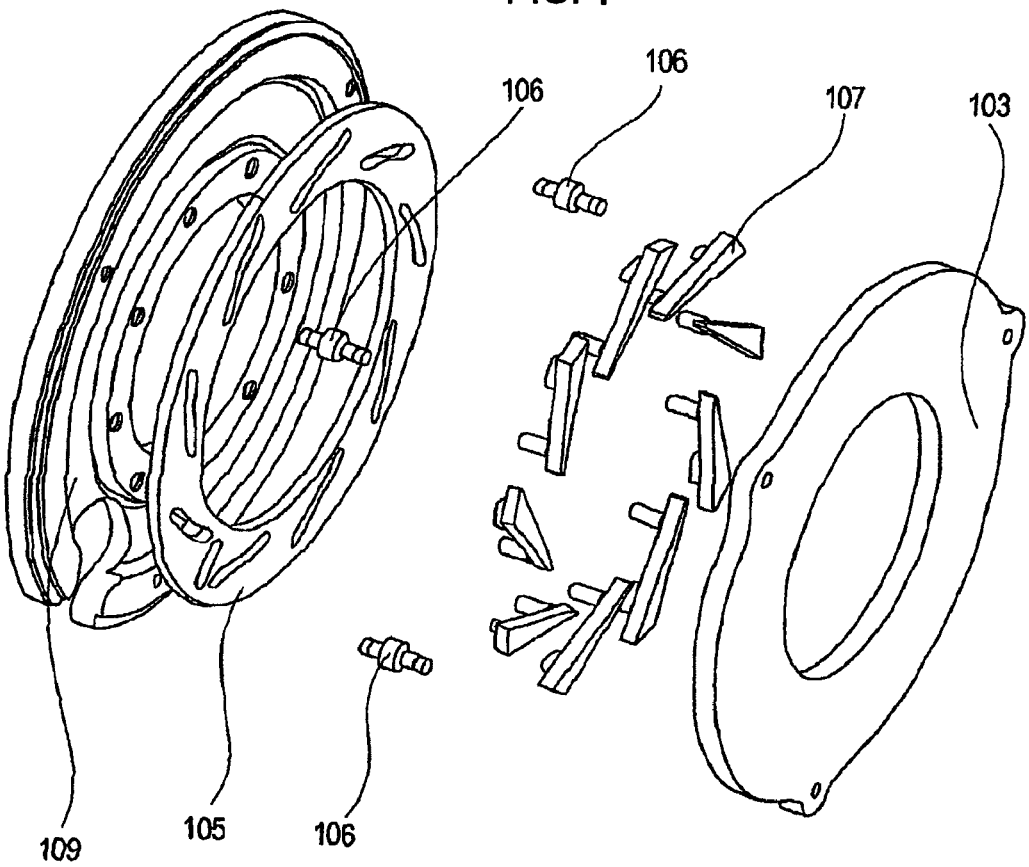
FIG. 1 shows a perspective view of components for a compressor nozzle device according to an example.
Figure 2:
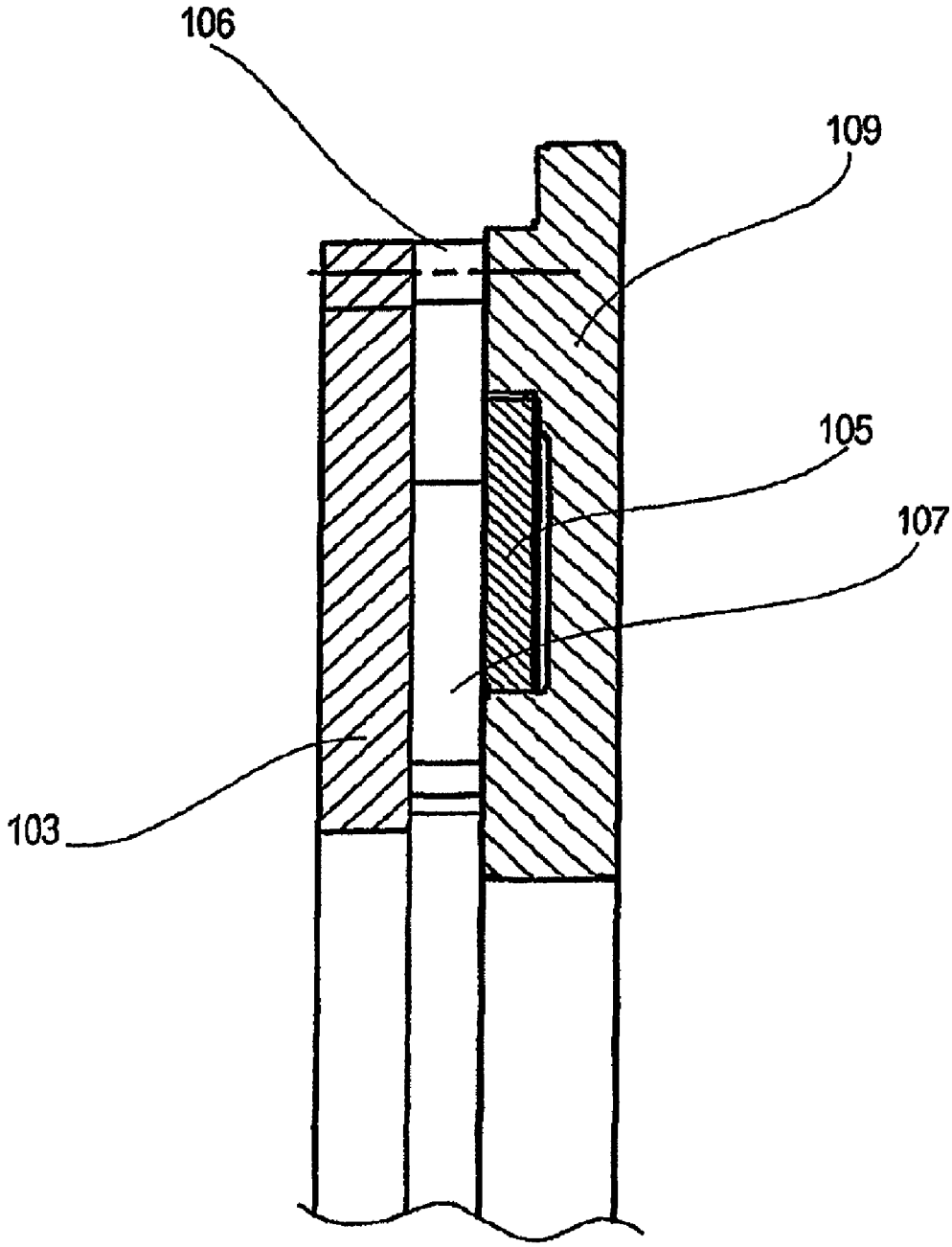
FIG. 2 shows a cross sectional view of a compressor nozzle device according to the example.
Figure 3:
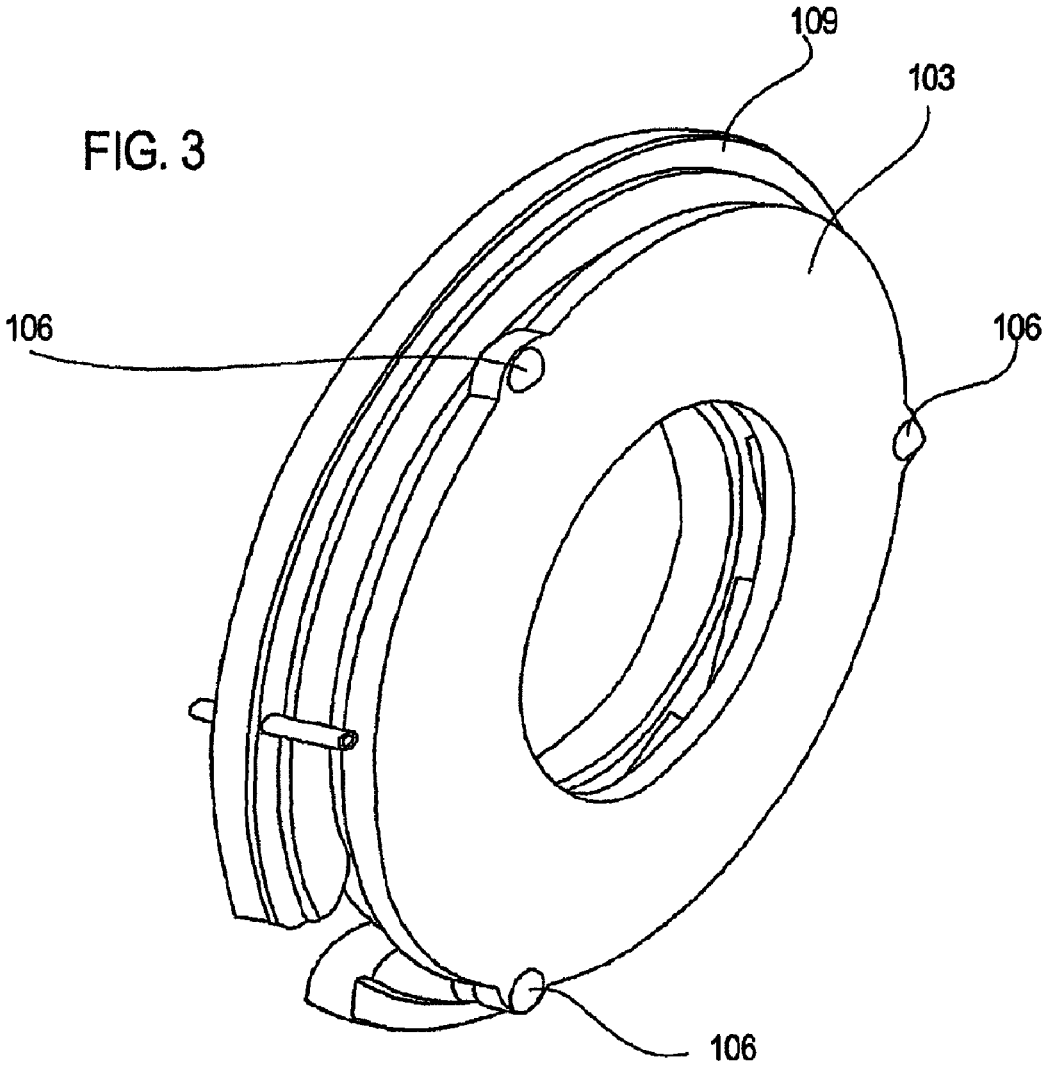
FIG. 3 shows a perspective view of an assembled compressor nozzle device according to the example.
Figure 4:
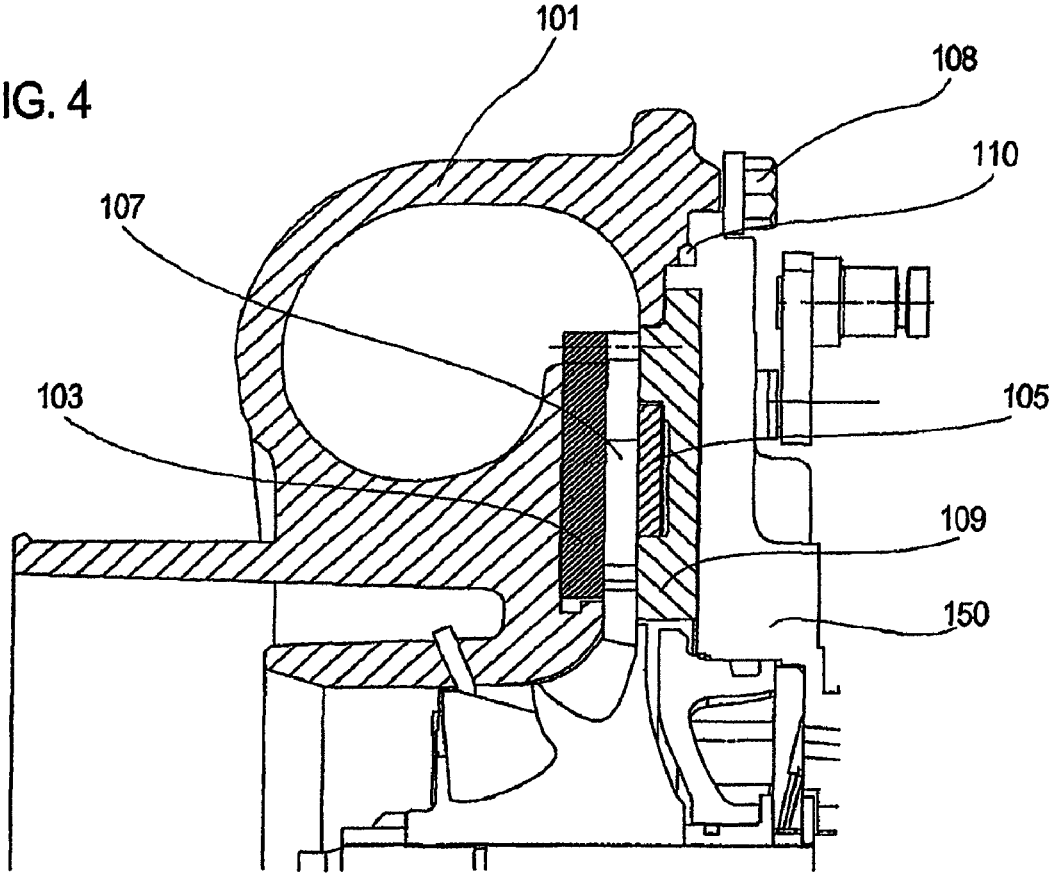
FIG. 4 shows a cross sectional view of a compressor nozzle device attached to a compressor housing according to the example.
Figure 5:
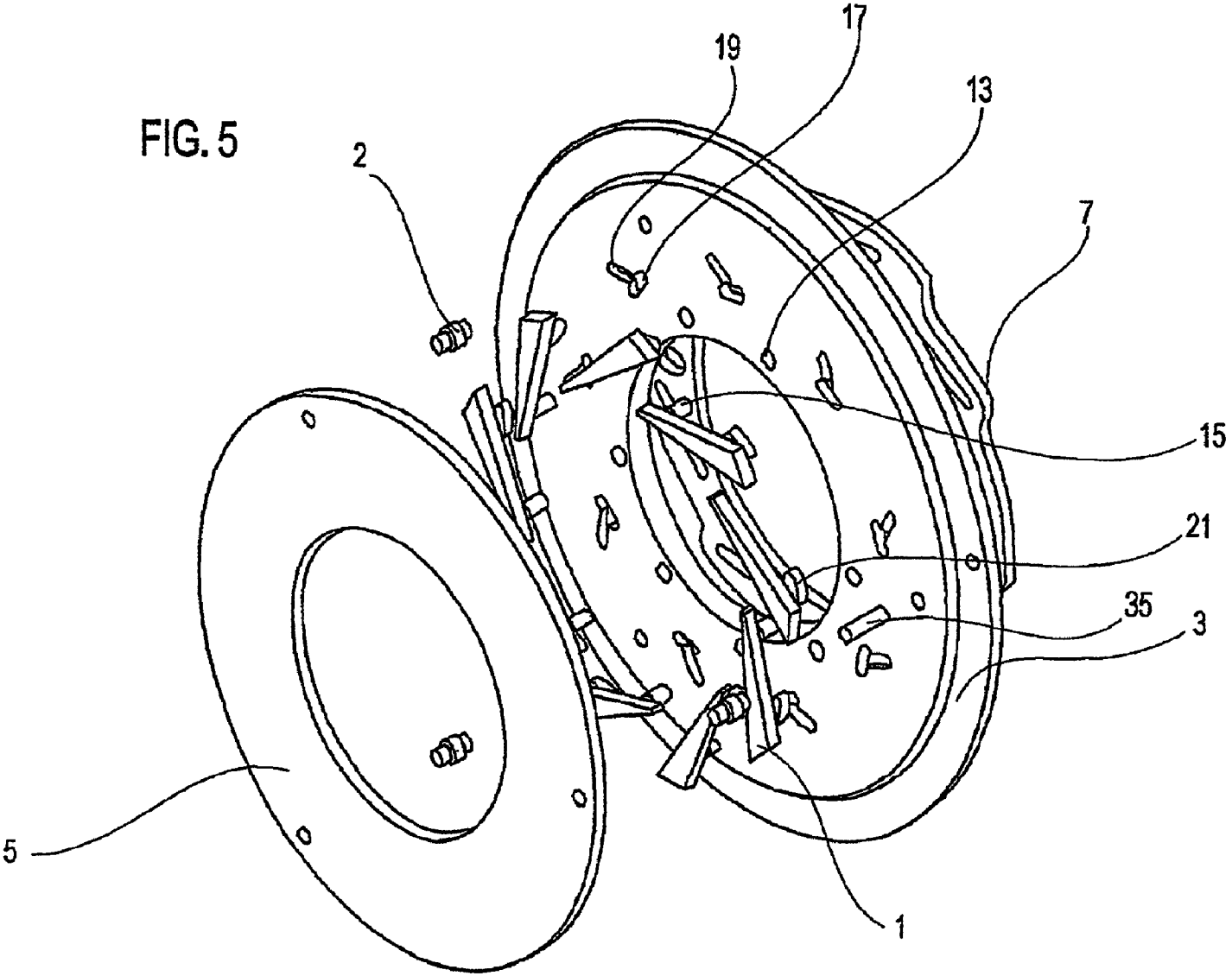
FIG. 5 shows an exploded view of a compressor nozzle device according to an embodiment of the invention, seen from a first side.

As can be seen from the exploded views in FIGS. 5 and 6, the variable geometry compressor cartridge (in the following referred to as "cartridge") has a first wall member 3 and a second wall member 5. Between these two wall members 3, 5, a set of adjustable vanes 1 is interposed. According to the embodiment, the number of vanes 1 is nine. In the following, the side of the first wall member 3 facing the vanes 1 will be called "vane side".

When seen from the top, the vanes 1 have a triangle shape. One edge of the triangle has a substantially shorter length than the other two edges. Thus, the two longer edges define a tip end of each vane 1 while the shorter edge defines a rear side.

Near the tip end of each vane 1 a pivot axle 15 is provided. Furthermore, near the rear end of each vane a shaft 22 is provided. A tab 21 is connected to the vane 1 by the shaft 22. The pivot axle 15 as well as the shaft 22 and the tab 21 protrude from the same triangle face. The shaft 22 and the tab 21 serve as actuating portion, while the pivot axle 15 serves as pivot portion.

In a radial inner portion of the first wall member 3, nine pivot holes 13 are provided. The pivot holes 13 serve to receive the pivot axles 15 of the respective vanes 1. Furthermore, in the wall member 3, nine assembly slots 17 are provided. The shape of the assembly slots 17 substantially corresponds to the cross-section of the tabs 21. Adjacent to the assembly slots 17, guiding slots 19 are provided. The assembly slots 17 as well as the guiding slots 19 fully extend through the wall member 3.

Figure 7:
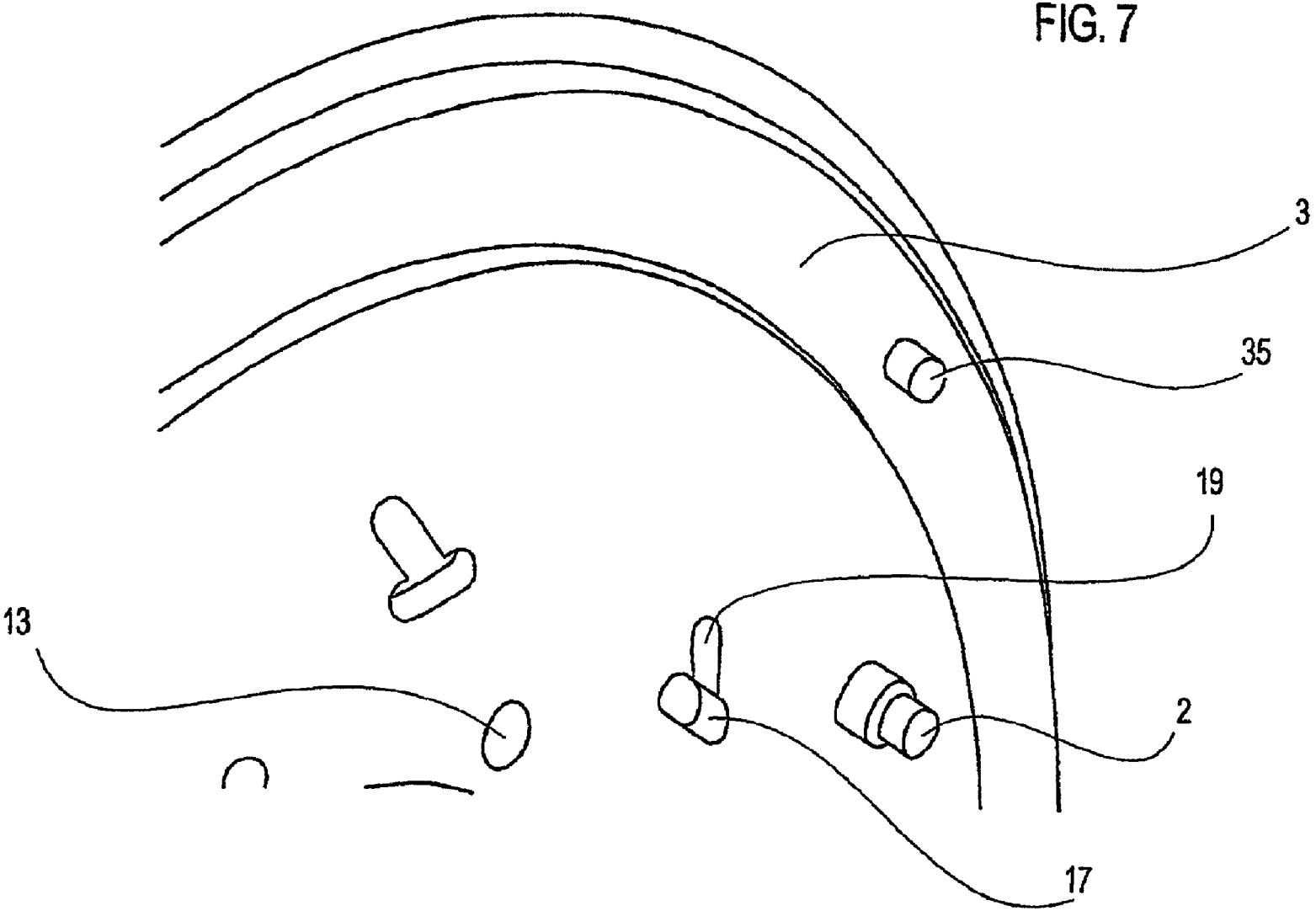
FIG. 7 shows a detailed perspective view of a first wall member according to the embodiment, seen from the first side.

A detailed view showing the arrangement of the pivot holes 13, assembly slots 17 and guiding slots 19 seen from the vane side is shown in FIG. 7. Furthermore, in FIG. 7 a spacer 2 can be seen, the function of which will be described later.

Figure 6:
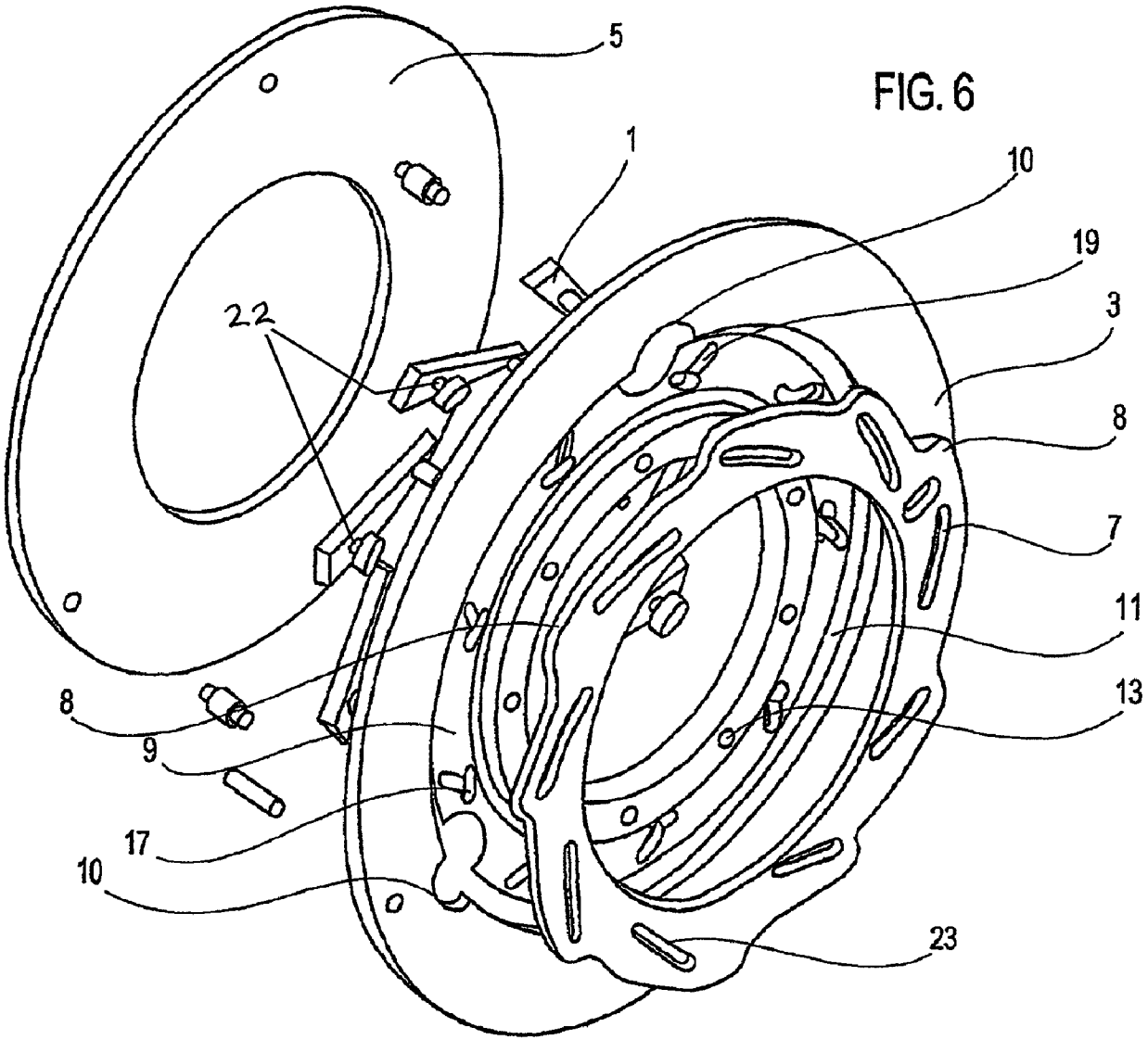
FIG. 6 shows an exploded view of the compressor nozzle device of FIG. 5, seen from a second side opposite to the first side.

As can be seen from FIG. 6, on the side of the wall member 3 opposite to the side facing the vanes 1, a circular groove 9 is provided. Along its circumference the groove 9 has a slot 11. Furthermore, at the circumference of the groove 9, three recesses 10 (only two said recesses being visible in FIG. 6) are provided. The groove 9, the recesses 10 and the slot 11 form a kind of bayonet socket. In the following, the side of the wall member 3 where the groove 9 is provided will be called "groove side".

A unison ring 7 is received in the groove 9. The unison ring 7 has a thickness slightly exceeding the thickness of the vane tabs 21 and a diameter slightly smaller than the diameter of the groove 9. According to the number of vanes 1, the unison ring 7 has nine actuating slots 23 for receiving the vane tabs 21. The outer circumference of the unison ring 7 has a wave-like shape, wherein three of the wave portions are formed as protrusions 8 exceeding the diameter of the groove 9 in order to project into the slot 11. Furthermore, the unison ring has a radial slot for coming into engagement with an actuating device (not shown).

When assembling the compressor nozzle device, the unison ring 7 is inserted into the groove 9 provided in the wall member 3. Thereby, the protrusions 8 at the outer circumference of the unison ring are axially inserted into the three recesses 10 of the groove 9. Thereafter, the unison ring 7 is twisted such that the protrusions 8 are received in the slot 11 of the groove 9, restricting an axial movement of the unison ring 7.

Next, the pivot axles 15 of each vane are inserted into the respective holes 13 in the wall member 3, while at the same time the vane tabs 21 are completely passed through the assembly slots 17 in order to be received in the actuating slots 23 of the unison ring 7. After the tabs 21 have been fully received in the respective actuating slots 23, the shafts 22 are essentially positioned within the respective assembly slots 17 of the wall member 3.

Figure 8:
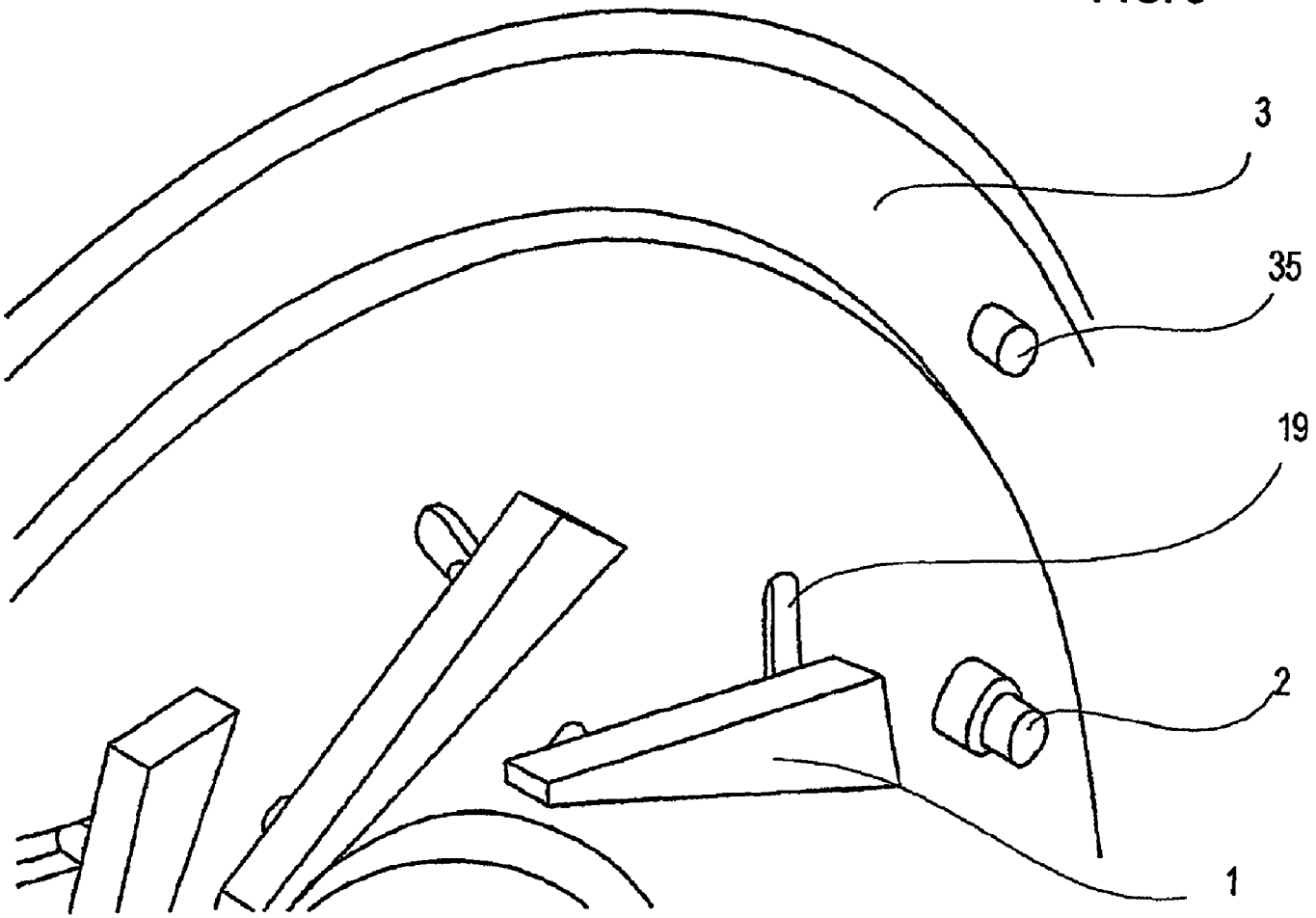
FIG. 8 shows another detailed perspective view of the first wall member according to the embodiment, seen from the first side.

FIG. 8 shows a detailed perspective view of the wall member 3 after the above described assembly steps have been completed. Thereafter, the wall members 3 and 5 are attached to each other, with spacers 2 being used for this purpose. The spacers 2 substantially have a cylindrical form and a thickened middle portion the length of which slightly exceeds the thickness of the vanes.

At their end portions, the spacers 2 are received in corresponding holes provided in the first and second wall member, respectively, and are fixed by known means, such as riveting. Thus, the distance between the two wall members is defined by the length of the thickened middle portion of the spacers 2.

By the assembly process described above, the compressor nozzle device is formed as a cartridge.

An actuating mechanism of the vanes according to the embodiment will be described on the basis of FIGS. 9 to 12.

Figure 9:
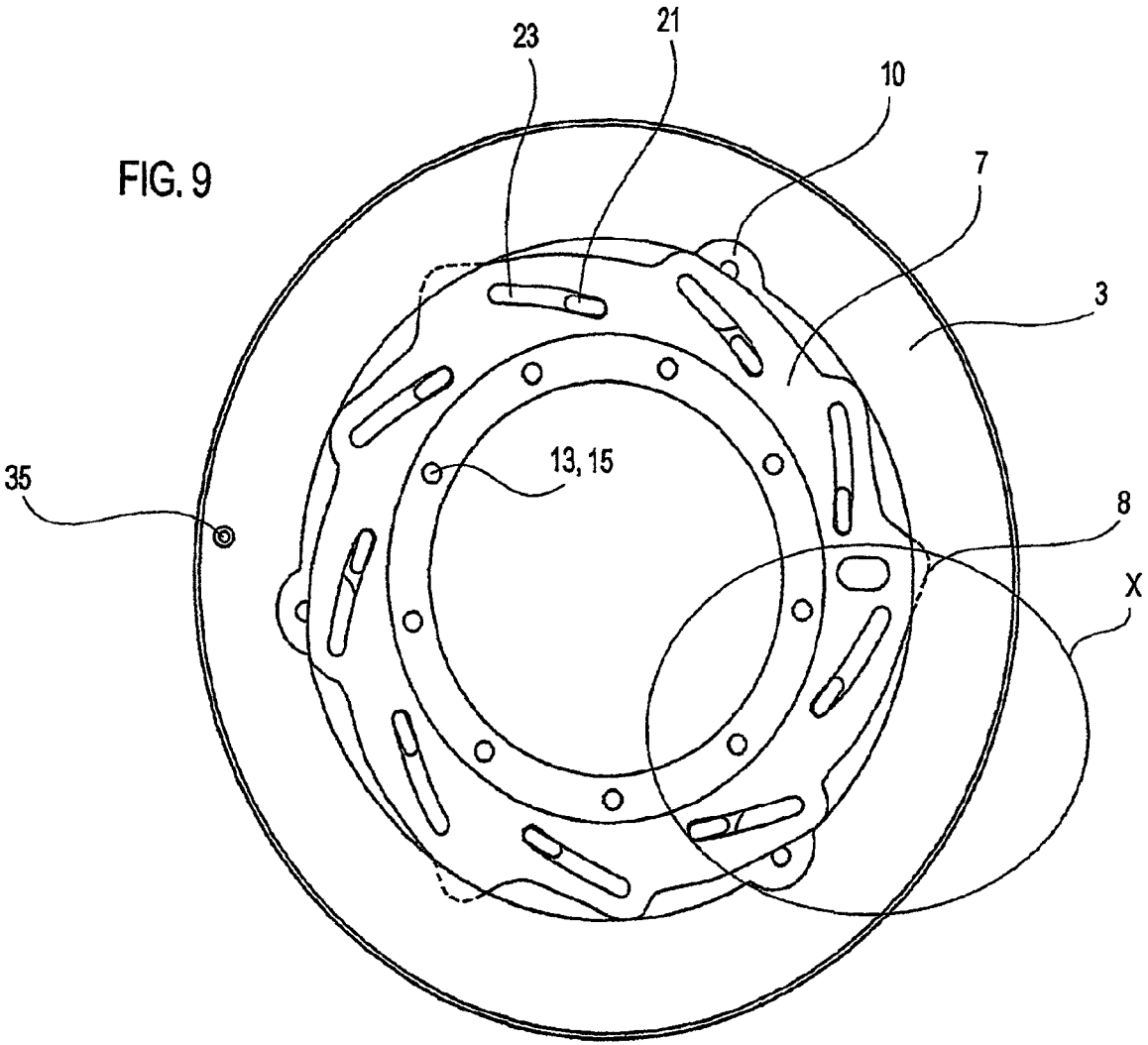
FIG. 9 shows a top view of the compressor nozzle device according to the embodiment, seen from the second side.
Figure 10:
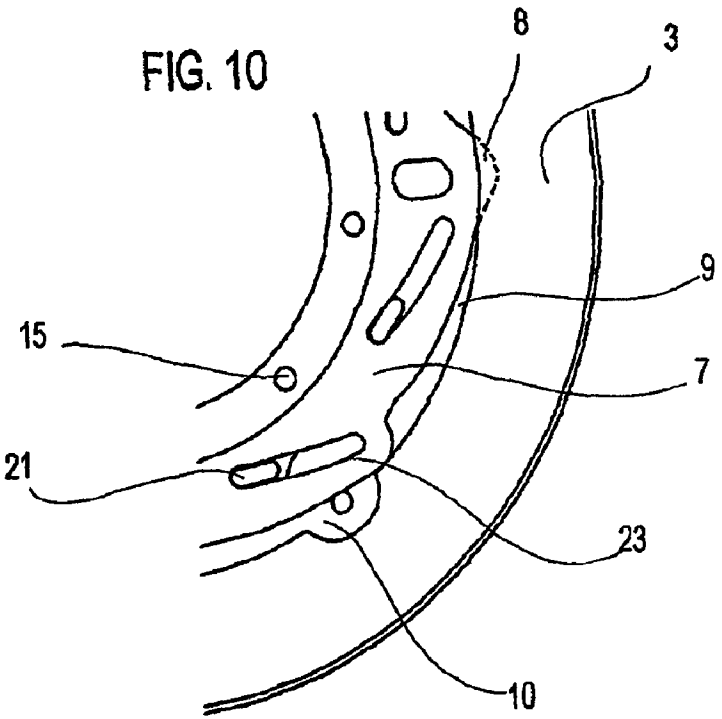
FIG. 10 shows a detail X of FIG. 9.

FIG. 9 is a top view of the groove side of the wall member 3, while FIG. 10 shows a detail "XI" of FIG. 9. As can be seen from these Figures, an inner end portion of the actuating slots 23 is in engagement with the tabs 21 of the vanes 1. Furthermore, the position of the tabs 21 shown in FIGS. 9 and 10 corresponds to the position achieved after the above described assembly steps have been completed.

Figure 11:
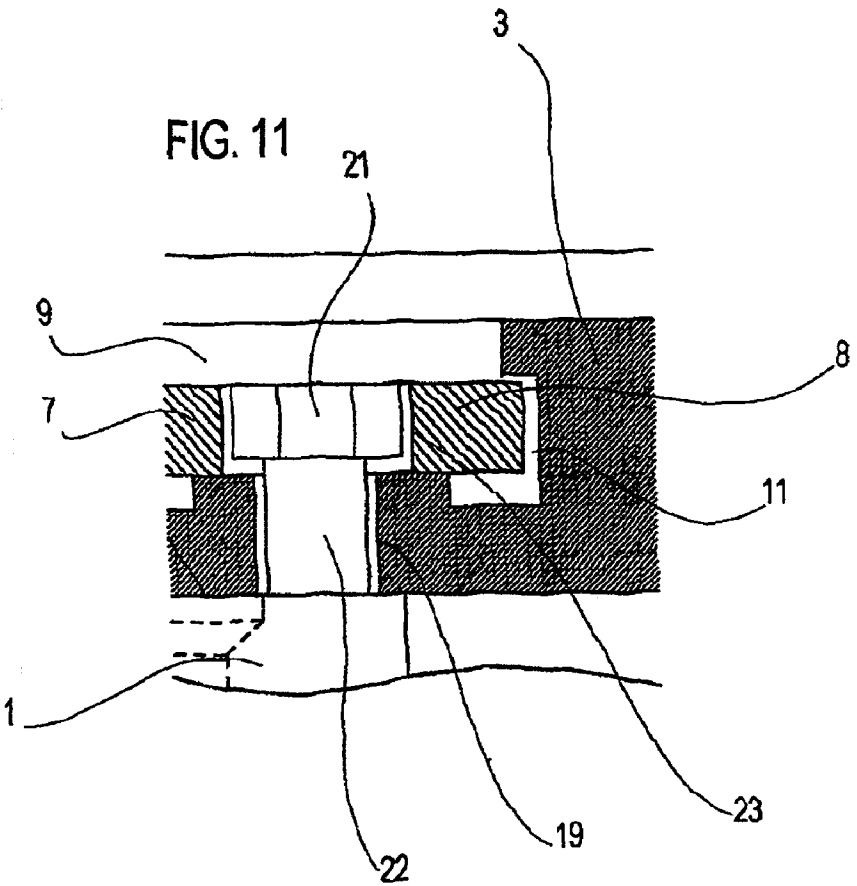
FIG. 11 shows a cross section of the compressor nozzle device in the area of an actuating slot.

FIG. 11 is a sectional view of the unison ring 7 and the wall member 3 in the area of an actuating slot 23. From the Figure it can be seen that, while the vanes 1 rotate around the pivot axles 15, the shafts 22 connecting the tabs 21 and the vanes 1 enter the guide slots 19. Furthermore, the protrusion 8 of the unison ring 7 provided in the slot 11 of the groove 9 is visible. The length of the shaft 22 slightly exceeds the width of the wall member 3 from the vane side to the bottom of the groove 9.

FIG. 12*a* is a top view of a portion of the wall member 3 which is seen from the groove side opposite to the vane side and which helps to explain the vane adjusting mechanism. On the right side of FIG. 12*a*, a portion of the unison ring 7 can be seen. For the sake of clarity, a large section of the unison ring 7 is cut away. In the Figure, non-visible parts, such as the vanes 1, are shown by dashed lines.

In FIG. 12*a* the lowest possible angle of inclination of the vanes 1 is shown. When the unison ring 7 is twisted in a clockwise direction in FIG. 12 by an external actuating mechanism, the respective radial inner edges of the actuating slots 23 exert a pressure on the tabs 21 of the vanes 1. Due to this pressure each tab is moved radially outwards and, thus, each vane 1 is rotated around the respective axle 15. The rotating movement of each vane 1 is restricted by the respective guiding slot 19 in which the respective shaft 22 connecting the respective tab 21 with the respective vane 1 is guided until the shaft 22 abuts against an outer end portion of the guiding slot 19. Thus, according to the embodiment, each vane 1 can be rotated around an angle $\alpha$ of 25°.

FIG. 12*b* shows the same components as FIG. 12*a* after the rotating movement of the vanes 1 has been stopped. From the position shown in FIG. 12*b* the vanes 1 can be rotated back by again twisting the unison ring 7 counter clockwise. In doing so, the radial outer sides of the actuating slots exert a pressure on the respective tabs 21 in order to again push them in a radially inward direction. Thus, the lowest possible angle of inclination of the vanes is again achieved.

As can be seen from FIGS. 12*a* and 12*b*, the twisting range of the unison ring 7 is limited, since the respective shafts 22 come into abutment with the outer end portions of the guiding slots 19 and with an inner wall of the assembly slots 17, respectively. However, within this twisting range the unison ring 7 can be continuously variably rotated and, thus, any required inclination angle in a range from $0° \leqq$ inclination angle $\leqq \alpha$ can be achieved for the vanes 1.

Furthermore, from FIGS. 12*a* and 12*b* it can be seen that independent of the angular position of the unison ring 7, the portions of each assembly slot 17 and of each guiding slot 19 are covered by the tab 21 and the portions adjacent to the actuating slots 23 of the unison ring 7. Furthermore, each vane 1 itself covers large portions of the respective assembly slots 17 and guiding slots 19.

Thus, an airflow is securely prevented from passing from the vane-side of the wall member 3 to its groove side. This arrangement on the one hand reduces an aerodynamic flow resistance, and, on the other hand, provides the advantage that particulates such as dust contained in the air flow cannot be deposited close to the moving parts such as the unison ring 7 or the tabs 21 of the vanes 1. This results in the minimization of the risk that the moving parts might get stuck, so that the operability of the compressor nozzle device is ensured.

A cartridge as described above can be used with a compressor of a turbocharger. Basically, a turbocharger is a device that uses exhaust gases produced by the engine to supply additional air into cylinders of the combustion engine. The turbocharger is mounted directly on the exhaust manifold, where exhaust gases pass over a turbine impeller that is attached to a shaft.

On the other side of this shaft, a compressor wheel is provided and is driven by the turbine via the shaft. The compressor wheel is located in a housing and draws suction air through an air filter, compresses this suction air and supplies it into an intake manifold of the engine via a volute in the housing. Thus, the energy from the exhaust gases, which would be wasted on a non-charged engine, is being used to supply additional air into the combustion engine leading to an increased engine power.

FIG. 13 is a sectional view of a compressor nozzle device where the cartridge comprising the wall members 3 and 5 attached to each other, the vanes 1 and the unison ring 7, is attached to a volute 31 of a compressor.

On the right side of FIG. 13, a center housing and rotating assembly 50 can be seen. The center housing and rotating assembly 50 connects a turbine side of a turbocharger with a compressor side via a shaft supported in the center housing. A compressor wheel 47 is attached to the shaft at its compressor side end.

Since the cartridge is manufactured as a sub assembly, the vanes 1 of the cartridge are already fully calibrated and after the cartridge has been attached to the volute, both can be aerodynamically tested, e.g. by using a certain testing device, before being attached to the housing 50.

The first wall member 3 of the cartridge is fixedly mounted to the volute 31 at a radial outer portion of the wall member 3. In this way, the wall member 3 projects into a circular groove 43 provided in a radial outer portion of the volute. At the bottom of this circular groove 43, a seal 41 is provided, which is kept in position by means of the wall member 3.

The angular position of the cartridge relative to the volute 31 is maintained by an angular orientation pin 35 which is passed through respective bores in the volute 31, the first wall member 3 and the housing 50 of the center housing and rotating assembly.

The second wall member 5 is fitted to the volute 31 by means of a liquid sealant 33. The liquid sealant is provided between the volute and the first wall member 5 and prevents a flow recirculation of the air flow. Therefore, due to the inventive design of the cartridge in combination with the liquid seal, the aerodynamic performance of the whole variable geometry compressor device is very high.

Furthermore, since merely the one wall member 3 is fixedly attached to the volute, a possible play between the other wall member 5 and the volute 31, as well as deformations due to e.g. thermal expansion occurring during operation can be compensated for.

In an inner portion of the volute 31, an air suction inlet member 37 is arranged so that a thermal insulation 39 is provided between said inlet member 37 and the volute 31. According to this embodiment, the thermal insulation material is air. Due to the thermal insulation, a heat transfer from the compressed air in the volute 31 to the sucked air in the inlet is prevented, thus enhancing the performance of the compressor.

The cartridge, the volute 31 and the inlet 37, shown on the left side of FIG. 13, form the compressor side of a turbocharger and are attached to the center housing 50 by known means, such as bolts 49.

FIG. 14 shows the compressor side after the attachment to the center housing 50. A circular protrusion 45 enters the circular groove 43, and a seal 51 provided in a radial inner portion of the center housing 50 comes into abutment with the wall member 3. Thus, the seal 41 and the seal 51 tightly seal the compressor side from the remainder of the turbocharger.

Especially, due to the arrangement of the first wall member 3 and the seal 41 at the bottom of the circular groove 43, a simple sealing mechanism providing a reliable seal is achieved, which allows a simple attaching of the turbocharger. Furthermore, a controlling step to control the sealing properties at the location of the groove 43 can be omitted.

In the foregoing, a preferred embodiment of the invention has been described with reference to the Figures. However, it will be apparent to a person skilled in the art that further modifications can be carried out without departing from the scope of the claims.

For example, the number of vanes and, thus, the number of assembly slots, pivot holes, actuating slots in the unison ring etc. are not restricted to nine but can be adapted to the individual requirements.

Furthermore, it would be advantageous obvious to adapt the shape of the vanes. For, instead of the triangle shape, the vanes may e.g. have a curved shape, or the longer edges of the vanes may be substantially parallel to each other.

Furthermore, the pivot axles can protrude from the face opposite to the face from which the shafts and the tabs protrude. Thus, the pivot axles will be received in the wall member other than the one which receives the shafts and tabs, respectively.

Furthermore, the length of the actuating slots can be such that the pivoting angle of the vanes is not defined by the abutment of the shafts with the end portions of the guiding slots, but is defined by the abutment of the tabs with the end portions of the actuating slots.

Furthermore, instead from air, the thermal insulation provided between the volute and the inlet of the compressor can be made from any suitable insulating material depending on the respective requirements of the compressor.

Although the nozzle device was described as a compressor nozzle device, it will be obvious to a person skilled in the art to use an equivalent nozzle device for a turbine, e.g. on a turbine side of a turbocharger.

Furthermore, the nozzle device is not restricted to be used with a turbocharger, but is suitable for any apparatus where fluids pass a flow path having a variable sectional area.

The invention claimed is:

1. A variable vane device for a compressor, comprising:

spaced, opposing first and second wall members;

a set of adjustable vanes interposed between said first and second wall members; and a unison ring for actuating said vanes, said unison ring being arranged at an outer side of said first wall member opposite to another side thereof facing said vanes, said unison ring having a plurality of circumferentially spaced protrusions extending outwardly from an outer periphery of said unison ring;

wherein said outer side of said first wall member is provided with a circumferential groove and the unison ring is received in said circumferential groove, wherein said circumferential groove has a plurality of circumferentially spaced recesses for axially receiving said protrusions of said unison ring, and wherein said groove defines an undercut circumferential slot;

wherein the unison ring is fitted into the groove in the first wall member with the protrusions aligned with the recesses and is then rotated to a position misaligning the protrusions relative to the recesses to axially restrain the unison ring relative to the wall member by engagement of the protrusions in the circumferential slot, and wherein the circumferential spacing between the recesses is such that the unison ring can be rotated through a range of angular rotation for adjusting the vanes between predetermined limit positions without the protrusions becoming aligned with the recesses.

2. The variable vane device according to claim 1, wherein said first wall member has guiding slots for guiding actuating portions of said vanes, said actuating portions engaging said unison ring.

3. The variable vane device according to claim 2, wherein said first wall member further has assembly slots for passing said actuating portions therethrough during assembly.

4. The variable vane device according to claim 2, wherein said unison ring has a plurality of actuating slots in engagement with respective actuating portions of said vanes for providing a vane actuating mechanism.

5. The variable vane device according to claim 3, wherein each of said vanes further has a pivot portion received in a pivot hole provided in one of said wall members, said vane being rotatable about said pivot portion.

6. The variable vane device according to claim 3, wherein said guiding slots and said assembly slots are covered at least by one of said vanes or said unison ring for preventing an air flow from passing through said guiding slots and through said assembly slots.

* * * * *